US011293086B2

(12) United States Patent
Ma et al.

(10) Patent No.: US 11,293,086 B2
(45) Date of Patent: Apr. 5, 2022

(54) CONNECTING DEVICE AND INTERNAL PLASMA SPRAYING SYSTEM

(71) Applicant: Army Academy of Armored Forces, Beijing (CN)

(72) Inventors: Guozheng Ma, Beijing (CN); Haidou Wang, Beijing (CN); Pengfei He, Luohe (CN); Shuying Chen, Beijing (CN); Ming Liu, Beijing (CN); Haijun Wang, Beijing (CN); Ling Tang, Beijing (CN); Shuyu Ding, Jianyang (CN); Yiwen Wang, Beijing (CN); Hengheng Xi, Yaohe Town (CN)

(73) Assignee: ARMY ACADEMY OF ARMORED FORCES, Beijing (CN)

( * ) Notice: Subject to any disclaimer, the term of this patent is extended or adjusted under 35 U.S.C. 154(b) by 488 days.

(21) Appl. No.: 16/281,062

(22) Filed: Feb. 20, 2019

(65) Prior Publication Data

US 2020/0199729 A1 Jun. 25, 2020

(30) Foreign Application Priority Data

Dec. 25, 2018 (CN) ..... 201811595675.X

(51) Int. Cl.
*C23C 4/134* (2016.01)
*B05B 9/00* (2006.01)

(52) U.S. Cl.
CPC ..... *C23C 4/134* (2016.01); *B05B 9/002* (2013.01)

(58) Field of Classification Search
None
See application file for complete search history.

(56) References Cited

U.S. PATENT DOCUMENTS 5,452,854 A * 9/1995 Keller ..... C23C 4/134 239/80
2013/0294855 A1* 11/2013 Freyermuth ..... B23Q 11/1023 408/18
2019/0071761 A1* 3/2019 Wang ..... C23C 4/02
2020/0255942 A1* 8/2020 Stoeckli ..... B05B 7/222

FOREIGN PATENT DOCUMENTS

CN 107400847 * 11/2017 ..... B05B 13/0221

* cited by examiner

*Primary Examiner* — Charles Capozzi

(57) ABSTRACT

A connecting device is configured to connect a spray gun and a spray device. The connecting device includes a balance adjusting assembly, a rotation radius adjusting assembly, a driving assembly and a docking assembly. The balance adjusting assembly includes a fixing plate and a slide block configured to slide in a dovetail groove of the fixing plate. The rotation radius adjusting assembly includes a slide seat slidably connected with the balance adjusting assembly. The driving assembly includes a screw assembly configured to drive the slide block and the slide seat to move synchronously toward or away from each other. The docking assembly is detachably connected with the rotation radius adjusting assembly and connected to the spray gun.

11 Claims, 8 Drawing Sheets

--Prior Art--

CONNECTING DEVICE AND INTERNAL PLASMA SPRAYING SYSTEM

CROSS-REFERENCES TO RELATED APPLICATIONS

This application claims priority to a Chinese patent application No. 201811595675.X filed on Dec. 25, 2018, the disclosure of which is incorporated herein by reference in its entirety.

TECHNICAL FIELD

The present disclosure relates to thermal spraying technologies, and in particular relates to a quickly installed connecting device for an internal plasma spraying system and an internal plasma spraying system.

BACKGROUND

In the industrial fields, such as machinery manufacturing, iron and steel metallurgy, aerospace and rail transit and the like, many parts that play an important supporting role have a bore, for example, an engine block of an automobile, a housing of a gas turbine, a chemical oil pipeline and the like. During operation, the inner wall of the bore will suffer various failures and damages (e.g., wear, corrosion and high temperature change, and the like), which will seriously affect the service safety of the parts and eventually cause the parts to be scrapped.

The internal plasma spraying technology is a material forming method. In this method, the spray gun is inserted into the bore along a direction parallel to the axis of the bore, so that the plasma beam generated by the spray gun is perpendicular to the axis of the bore, and the powder is heated and accelerated in a very short time, and stacked and deposited on the inner surface of the bore to form a coating layer. This technology can form a coating layer on the inner wall with strengthened function such as anti-corrosion, abrasion resistance and high temperature resistance, and has high production efficiency and low cost. Therefore, the internal plasma spraying technology plays an important role in the modification and re-manufacturing of the bored part.

Internal plasma spraying is divided into two operation modes. The first mode is that the plasma spray gun only moves in the axial direction, and the workpiece to be sprayed rotates. The second mode is that the spray gun moves up and down and also rotates around an axis, and the workpiece to be sprayed is kept fixed. The second mode is free from the limitation of the geometric size and complex shape of the bored part, and does not need a special tool to make the workpiece rotate stably around its center of mass at a high speed. Therefore, the second mode is important in the internal thermal spraying technology, and is widely used.

Compared with the conventional translating internal spraying system, the rotary plasma spraying system has a more complex structure. In addition to the plasma spray gun, the core parts of the rotary plasma spraying system further include a rotary coupling assembly. The rotary coupling assembly includes a rotary transmission module, a rotary conveying module (transmission medium is gas-liquid) and a sealing module. Through the rotary coupling assembly, when the spray gun is painting the inner wall of the workpiece under high-speed rotation, the reliable non-winding transmission of various gases, water, electricity and powder required by the operation of the spray gun can be ensured.

However, at present, there are two technical difficulties in the rotary internal plasma spraying system.

1) The radius of rotation is fixed and the spray distance is determined by the inner diameter of the bore of the workpiece.

Specifically, as shown in FIG. 1, the workpiece to be sprayed is fixed, and the spray gun is movable along the axis Z and is rotatable in the X-Y plane about the central axis of the bore. The radius of the rotation of the spray gun around the axis is r0, and the radius of the two bores are r1 and r2 (r2>r1), and the spraying distances are r0+r1 and r0+r2, However, for the bored part with larger size, the radial distance d from the back of the spray gun to the nearest inner wall cannot be fully utilized. For the internal spraying in the limited space, the spraying distance directly determines the quality of the coating. For plasma spraying, the powder must have a basic heating and acceleration process in the plasma beam. To ensure the quality of the coating, the heating and acceleration process needs to be achieved at a suitable spray distance (Generally, for metal-based materials, the spraying distance is larger than 90 mm, for ceramic-based materials the spraying distance is larger than 70 mm.). Then, if the spraying distance is too short, the powder does not have enough time to be melted, and the coating contains a large number of un-melted/semi-melted particles, and more structural defects appears (pores and cracks, and the like). For example, for an engine block of an automobile or heavy-duty vehicle, the diameter of the bore is 70 mm-150 mm, and accordingly the actual spraying distance is less than 35 mm-75 mm, so the service performance of the coating prepared in this manner is difficult to be guaranteed.

2) the replacement of various types of internal spray gun is complicated.

In actual, there are various bores having different sizes (diameter and length), so plasma spray guns corresponding to various bore sizes are provided. In the internal spraying, the volume and power of the spray gun are two aspects that are difficult to satisfied at the same time. Generally, a small bore (with an inner diameter less than 80 mm) can only be sprayed with a small-volume, low-power spray gun, while a large bore (with an inner diameter more than 140 mm) can be sprayed with a medium or high power spray gun. In addition, when spraying a long bore, it is necessary to use an extended spray gun with a large centrifugal force. Therefore, in actual applications, spray gun is replaced frequently. In the traditional replacement method, the line ports of the spray gun and the corresponding interfaces at the rotary joint assembly need to be connected, which include a water pipe, a power cable, a working air pipe and a powder feeding pipe, and the like. The sealing of various gas pipes and liquid pipes and whether the anode and cathode are short-circuited needs to be checked carefully, which is time consuming and troublesome.

SUMMARY

The present disclosure provides a connecting device and an internal plasma spraying system, capable of flexibly, precisely, conveniently and adjusting the spraying distance and keeping a flexible rotation balance. During the of the spray gun is replaced, a quick and reliable connection is realized by the connecting device, thereby ensuring the absolute stability of the spray gun when the spray gun is rotating at a high speed.

According to an aspect of the present disclosure, a connecting device is provided. The connecting device is applied in an internal plasma spraying system and used for connecting a spray gun and a spray device. The connecting device includes: a balance adjusting assembly, a rotation radius adjusting assembly, a driving assembly and a docking assembly.

The balance adjusting assembly includes a fixing plate and a slide block. The fixing plate is fixed to the spray device, and the slide block is slidably connected with the fixing plate. The rotation radius adjusting assembly includes a slide seat, which is slidably connected with the balance adjusting assembly. The driving assembly includes a screw assembly, which is configured to drive the slide block and the slide seat to move synchronously toward or away from each other. The docking assembly is detachably connected with the rotation radius adjusting assembly, and is configured to be connected with the spray gun.

In an exemplary embodiment, the balance adjusting assembly further includes a fixed block, which is detachably connected with the fixing plate. The slide seat is slidably connected with the fixed block, and the screw assembly is rotatably connected with the fixed block.

In an exemplary embodiment, the balance adjusting assembly further includes a limiting block, and the slide block is provided with a groove. A first end of the limiting block is fixed to the fixing plate, a second end of the limiting block is in the groove, and the second end of the limiting block abuts an inner sidewall of the groove when a distance between the slide block and the fixed block is maximum.

In an exemplary embodiment, the balance adjusting assembly further includes a compression screw, which is configured to fix the slide block to the fixing plate in response to determining that the slide block is in position.

In an exemplary embodiment, the slide seat is provided with a cavity, a plurality of first jointers are arranged in the cavity, and the docking assembly is provided with a plurality of second jointers which are in one-to-one correspondence with the plurality of first jointers.

In an exemplary embodiment, the rotation radius adjusting assembly further includes two locking rings configured to open or close the cavity. A first end of each of the two locking rings is rotatably connected with the slide seat, and second ends of the two locking rings are detachably connected with each other by a locking lever.

In an exemplary embodiment, one side of the slide seat is provided with a sheath, the sheath includes two rotary shafts arranged in parallel and spaced apart from each other, and each of the two locking rings is rotatably connected with a respective one of the two rotary shafts.

In an exemplary embodiment, the docking assembly includes a spray gun holder, the plurality of second jointers are arranged on the spray gun holder, the spray gun holder is detachably connected with the two locking rings, and each of the plurality of second jointers is connected with the spray gun via a copper pipe.

In an exemplary embodiment, an inner wall of each of the two locking rings is provided with a protrusion, and an external surface of the spray gun holder is provided with a recess engagable with the protrusion.

In an exemplary embodiment, the screw assembly includes a left-handed screw, a right-handed screw and a locating pin. The locating pin is configured to connect the left-handed screw and the right-handed screw, the left-hand screw is screwed to the slide block, and the right-hand screw is screwed to the slide seat.

In another aspect, the present disclosure provides an internal plasma spraying system. The internal plasma spraying system includes a spray gun, a spray device, and the above connecting device. The fixing plate of the balance adjusting assembly of the connecting device is fixed to the spray device, and the spray gun is mounted to the docking assembly.

The present disclosure provides a quickly installed connecting device for internal rotary plasma spraying. The connecting device is used for connecting the spray gun and the spray device. The connecting device can be quickly installed. With the connecting device, the rotation radius of the spray gun is flexibly adjusted. The screw assembly of the driving assembly drives the slide block and the slide seat to move synchronously toward or away from each other. The rotation radius of the spray gun is adjusted by the movement of the slide seat. The slide block is used for keeping weight balance to reduce the radial movement of the spray gun when the spray gun is rotating. The rotation radius adjusting assembly and the docking assembly are detachably connected. Various spray guns of different powers or lengths may be mounted to the docking assembly according to the sizes of the bore and actual demands. The replacement of the spray gun is fast and simple. The spray gun can be firmly mounted to the docking assembly of the connecting device.

Figure 1:
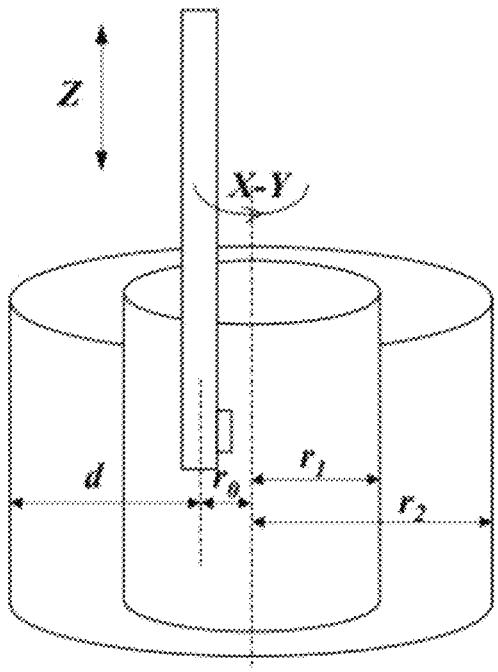
FIG. 1 is a diagram of a rotary internal plasma spraying in the related art.

1—balance adjusting assembly; 11—fixing plate; 12—fixed block; 13—slide block; 131—groove; 14—limiting block; 15—fastening screw; 16—compression screw;

2—rotation radius adjusting assembly; 21—slide seat; 22—first jointer; 23—locking ring; 24—sheath; 25—locking lever;

3—driving assembly; 31—screw assembly; 311—left-handed screw; 312—right-handed screw; 313—locating pin; 32—deep groove ball bearing; 33—bearing cap;

4—spray gun docking assembly; 41—spray gun holder; 42—second jointer; 43—spray gun mounting flange; 44—copper pipe.

DETAILED DESCRIPTION

The technical solutions of the present disclosure will be further described in detail below with reference to the accompanying drawings and embodiments of the present disclosure. It is to be understood that the embodiments set forth below are intended to illustrate and not to limit the present disclosure. Additionally, it is to be noted that to facilitate the description, merely a part of structures related to the present disclosure rather than the whole structure are illustrated in the drawings.

As shown in FIGS. 2 to 9, embodiments of the present disclosure provide a connecting device for internal rotary plasma spraying. The connecting device is applied in an internal plasma spraying system including a spray gun and a spray device. The connecting device is configured to connect the spray gun and the spray device. The connecting device for internal rotary plasma spraying includes a balance adjusting assembly 1, a rotation radius adjusting assembly 2, a driving assembly 3 and a docking assembly 4 for docking a spray gun. The balance adjusting assembly 1 is used for ensuring the rotation balance of the spray gun when the spray gun is rotating. The driving assembly 3 is used for synchronously adjusting the balance adjusting assembly 1 and the rotation radius adjusting assembly 2. The docking assembly 4 is used for fixing the spray gun, that is, the spray gun is removably mounted to the docking assembly 4. The connecting device for internal rotary plasma spraying will be further described in detail below The balance adjusting assembly 1 includes a fixing plate 11, a fixed block 12, a slide block 13 and a limiting block 14. The fixing plate 11 is configured to be fixed to the spray device, such that the connecting device and the spray gun are fixed to the spraying device. In an exemplary embodiment, the shape of the fixing plate 11 is round.

The fixed block 12 is detachably connected with the fixing plate 11. The slide block 13 is slidably connected with the fixing plate 11. A dovetail groove is arranged on one side of the fixing plate 11. The dovetail groove is straight and extends in a radial direction of the fixing plate 11. A first surface of the fixed block 12 is provided with a projection matched with the dovetail groove, and a first surface of the slide block 13 is also provided with a projection matched with the dovetail groove. The fixed block 12 is connected with the fixing plate 11 by a fastening screw 15. In an alternative embodiment, the fixed block 12 is fixed to one specified position on the fixing plate 11. In another embodiment, the fixed block 12 may be fixed to different positions on the fixing plate 11 according to actual needs. The slide block 13 is slidably connected with the fixing plate 11 via the projection and the dovetail groove. The slide block 13 can slide along the extension direction of the dovetail groove. When the slide block 13 slides to an appropriate position, the slide block 13 and the fixing plate 11 are locked together using a compression screw 16.

The fixing plate 11 has a central axis. The fixed block 12 and the slide block 13 are located on two opposite sides of the central axis respectively. The slide block 13 has a first position and a second position. The slide block 13 can slide between the first position and the second positon. When the slide block 13 is at the first position, the fixed block 12 and the slide block 13 are abutting with each other, and an inner edge of the fixed block 12 and an inner edge of the slide block 13 are both located at the central axis, that is, the distance between the slide block 13 and the central axis is 0. When the slide block 13 is at the second position, the slide block 13 has a maximum distance with respect to the central axis. The slide block 13 can move along the extension direction of the dovetail groove between the first position and the second position.

The slide block 13 is provided with a groove 131. For example, the groove 131 is provided on the first surface of the slide block. A sidewall of the groove 131 is provided with a scale used for determining the distance between the center axis and the slide block 13. A first end of the limiting block 14 is fixed to the fixing plate 11, a second end of the limiting block 14 is in the groove 131. As the slide block 13 moves along the radial direction of the fixing plate 11 (that is, along the dovetail groove), the relative position of the limiting block 14 with respect to the groove 131 varies. The groove 131 also extends in radial direction of the fixing plate 11. The groove 131 has two lateral sidewalls and an inner sidewall which is arranged at an end of the groove 131 close to the central axis. The slide block 13 can move from the first position where the slide block 13 is in contact with the fixed block 12 to the second position where the limiting block 14 abuts the inner sidewall of the groove 131. The distance between the slide block 13 and the fixed block 12 is 0 when the slide block 13 is in the first position, and is maximum when the slide block 13 is in the second position. When the spraying process is complete, the slide block 13 is moved back to the first position.

In this embodiment, the slide block 13 is made of stainless steel, the slide block 13 is used for weight adjustment, that is, for adjusting center of gravity when the spray gun is installed on the connecting device. The fixed block 12 is made of light aluminum alloy.

The rotation radius adjusting assembly 2 includes a slide seat 21. The slide seat 21 is slidably connected with the balance adjusting assembly 1. A second surface of the fixed block 12 away from the fixing plate 11 is provide with a dovetail groove. The dovetail groove of the fixed block 12 also extends in the radial direction. The slide seat 21 is provided with a protrusion matched with the dovetail groove, so that the slide seat 21 is slidably connected with the fixed block 12. When the slide seat 21 slides to an appropriate position, the slide seat 21 and the fixed block 12 are fixed by the compression screw 16.

The slide seat 21 can move relative to the fixed block 12. The movement direction of the slide seat 21 is opposite to the movement direction of the slide block 13. The slide seat 21 has an initial position where the central axis of the slide seat 21 and the central axis of the fixing plate 11 coincide. When the slide seat 21 is at the initial position, a distance between the central axis of the slide seat 21 and the central axis of the fixing plate 11 is 0. As the slide seat 21 moves along the dovetail groove of the fixed block 12, the distance between the central axis of the slide seat 21 and the central axis of the fixing plate 11 becomes larger. The fixed block 12 is provided with a scale for determining the moving distance of the slide seat 21 (that is, the distance between the central axis of the slide seat 21 and the central axis of the fixing plate 11). The moving distance of the slide seat 21 determines the rotation radius of the spray gun.

The slide seat 21 is provided with a cavity, and a plurality of first jointers 22 are arranged in the cavity. The docking assembly 4 is provided with a plurality of second jointers 42 which are in one-to-one correspondence with the plurality of first jointers 22. In this embodiment, the plurality of first jointers 22 include two water jointers, two electrical jointers and at least three air jointers. First ends of these first jointers are respectively connected with the water outlet, water inlet, anode interface, cathode interface, plasma air interface, powder feeding air interface and cooling air interface provided on the spraying device via flexible hoses and cables. Sufficient space is reserved between the fixing plate 11, the slide block 13, the fixed block 12 and the slide seat 21 to facilitate the installation of the connecting hoses and cables, so that the slide seat 21 can move along the radial travel within a large range. The water jointer and the electric jointer can be combined into an integral jointer at the slide seat 21.

The second end of each of the plurality of first jointers 22 is provided with two sealing rings. Further, the second end of the first jointer 22 has a tapering surface for guiding and sealing, which is convenient for connection with the docking assembly 4.

The rotation radius adjusting assembly 2 further includes two locking rings 23 configured to open or close the cavity, a first end of each of the two locking rings 23 is rotatably connected with the slide seat 21, and second ends of the two locking rings 23 are detachably connected by a locking lever 25. When the locking lever 25 is unlocked, the two locking rings 23 can rotate relative to the slide seat 21, such that the cavity can be opened to facilitate the connection of the plurality of first jointers 22 and the plurality of second jointers 42.

One side of the slide seat 21 is provided with a sheath 24, and the sheath 24 includes two rotary shafts arranged in parallel and spaced apart. Each of the two locking rings 23 is rotatably connected with a respective one of the two rotary shafts. The two locking rings 23 are located on two sides of the sheath 24 respectively.

The docking assembly 4 for docking the spray gun includes a spray gun holder 41. The plurality of second jointers 42 are arranged on the spray gun holder 41. The spray gun holder 41 is detachably connected with the two locking rings 23. An inner wall of each of the two locking rings 23 is provided with a protrusion, an external surface of the spray gun holder 41 is provided with a recess engagable with the protrusion. When the two locking rings 23 are moved, the cavity is opened, and an operator can place the spray gun holder 41 in the cavity. The cavity can be closed by moving two locking rings 23 back, the protrusion and the recess are engaged, and the two locking rings 23 are locked via the locking lever 25.

The docking assembly 4 further includes a spray gun mounting flange 43 for mounting the spray gun. The spray gun mounting flange 43 is connected with an end of the spray gun holder 41 away from the two locking rings 23. The spray gun mounting flange 43 is configured to fix the spray gun tightly and reduce the undesired radial vibration of the spray gun under the action of high speed centrifugal force. The second jointers 42 include two water-electric connectors and at least three air pipe connectors. A first end of each of the plurality of second jointers 42 is connected with a respective one of the plurality of first jointers 22, and a second end of each of the plurality of second jointers 42 is fixed and welded with the spray gun line via a copper pipe 44. An inner space of a cavity of the spray gun holder 41 is filled with insulating sealant.

The docking assembly 4 is integrated with the spray gun, and corresponds to a spray gun of a specific model. That is, during the replacement of the spray gun, the spray gun and the docking 4 are replaced together. In the process of installing the spray gun, the plurality of second jointers 42 of the docking assembly 4 are respectively connected to the plurality of first jointers 22 of the rotation radius adjusting assembly. The tapering surface of the first jointer 22 and the tapering surface of the corresponding second jointer 42 are in reliable contact, and are sealed by two sealing rings, such that the reliable connection of electric, water and gas are achieved. After the first jointer 22 and the second jointer 42 are docked, the two locking rings 23 are securely buckled together through the locking lever 25 and by means of the protrusions on the two locking rings 23 and recesses on the spray gun holder 41.

When the spray gun needs to be replaced, it just needs to unlock the two locking rings 23 by releasing the locking lever 25, remove the spray gun, and install another spray gun (together with a corresponding docking assembly 4) according to the above-mentioned installation procedure. The replacement process is easy to operate, the sealing is reliable, and the spray gun is firmly installed.

Figure 2:
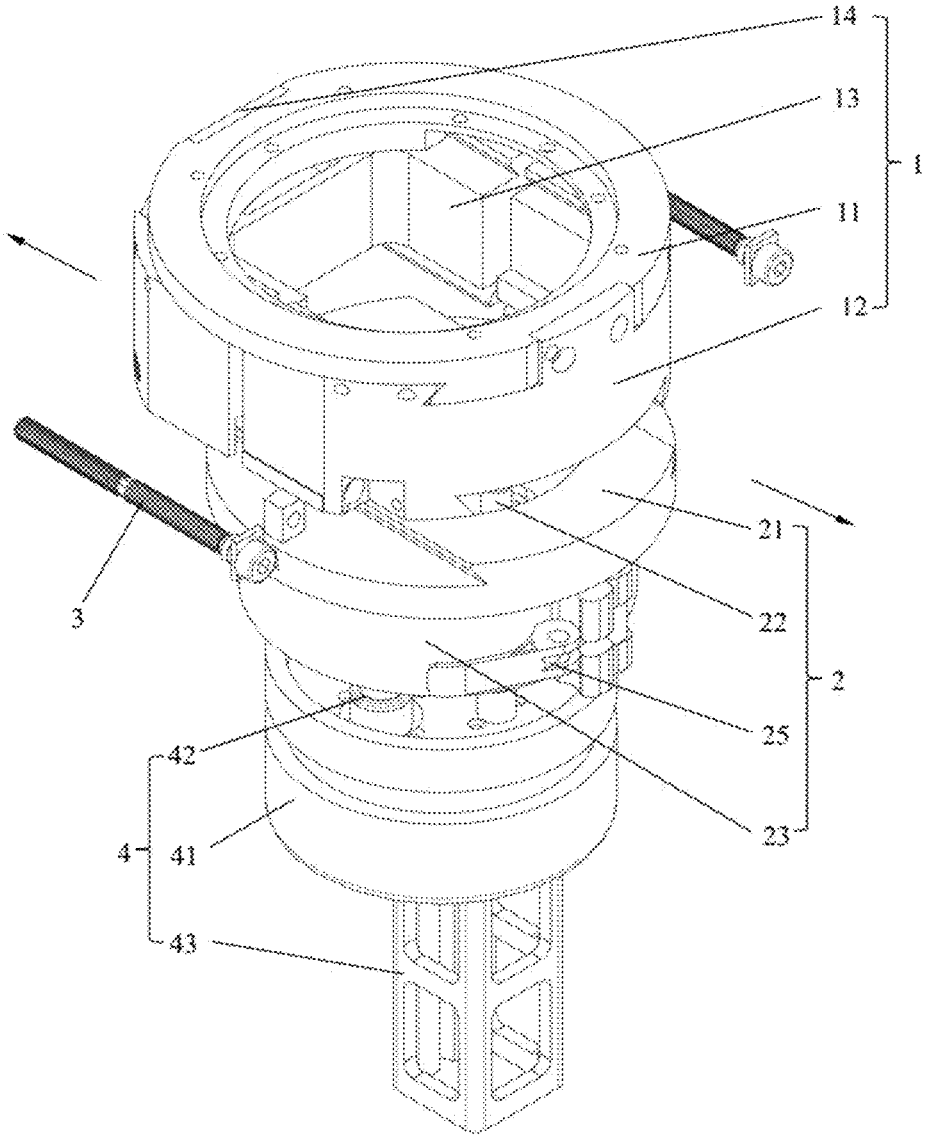
FIG. 2 is an exploded view of a connecting device for internal rotary plasma spraying according to an embodiment of the present disclosure.
Figure 3:
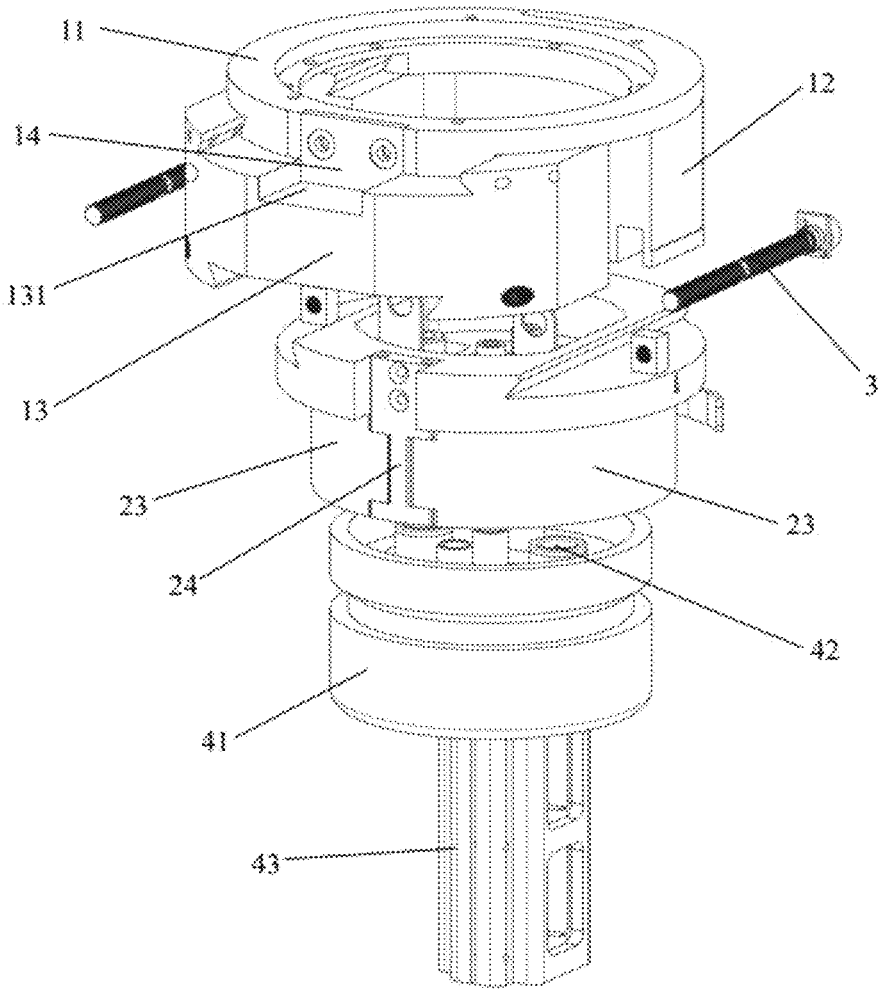
FIG. 3 is another exploded view of the connecting device for internal rotary plasma spraying according to an embodiment of the present disclosure.
Figure 4:
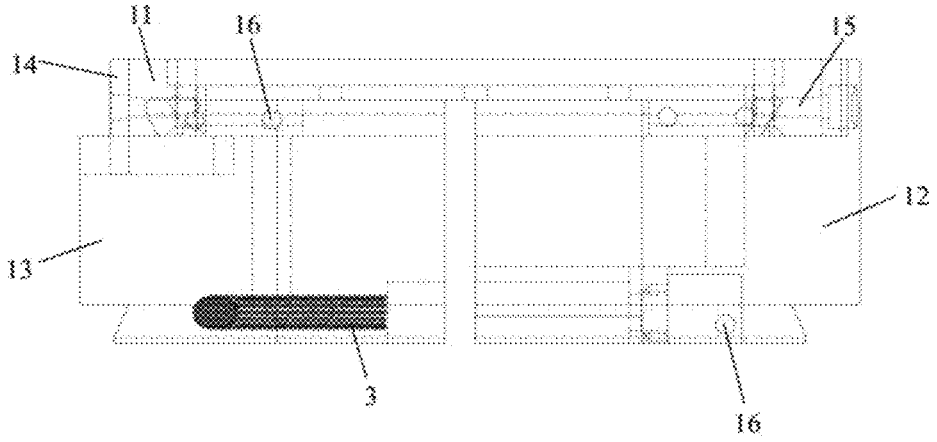
FIG. 4 is a front view of a balance adjusting assembly according to an embodiment of the present disclosure.
Figure 5:
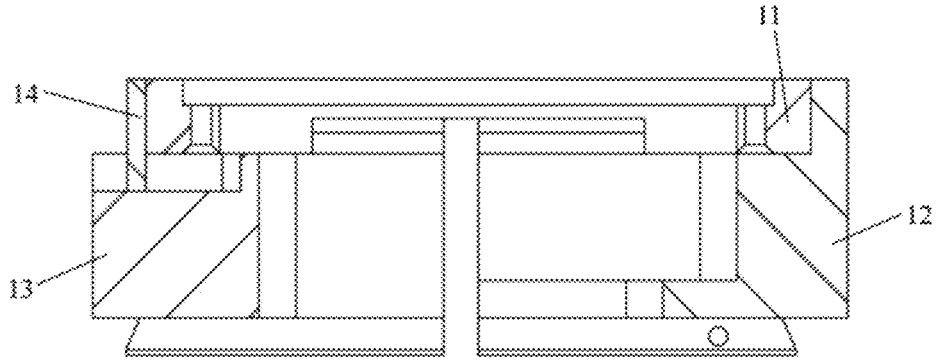
FIG. 5 is a cross-sectional view of the balance adjusting assembly in FIG. 4.
Figure 6:
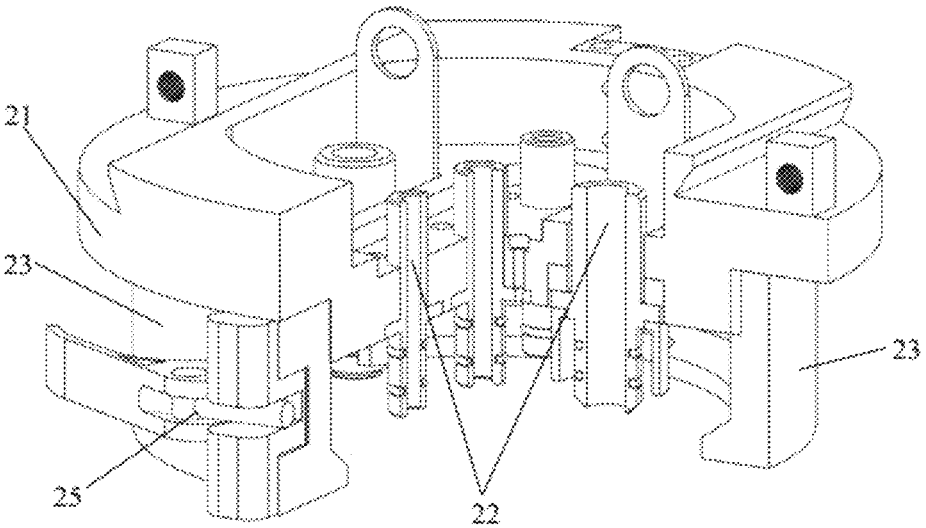
FIG. 6 is a partial cross-sectional view of a rotation radius adjusting assembly according to an embodiment of the present disclosure.
Figure 7:
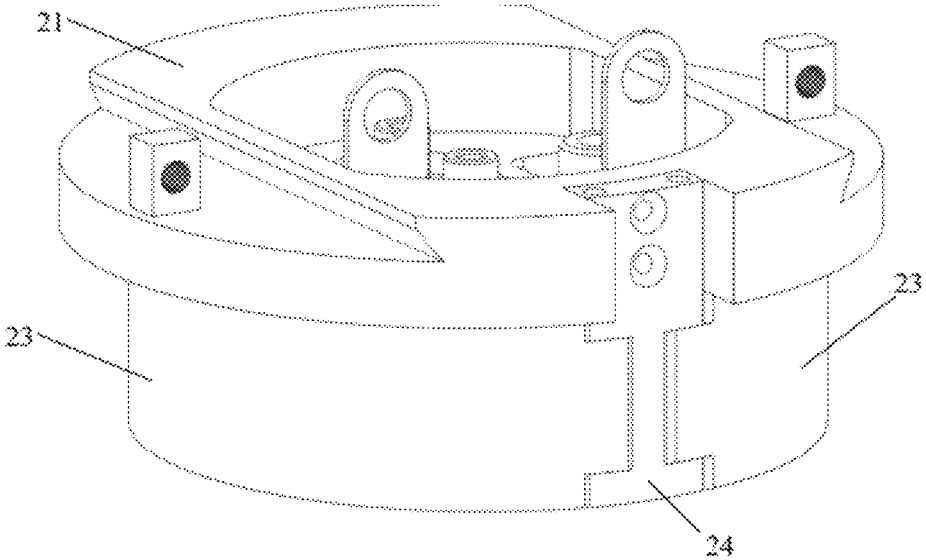
FIG. 7 is a structural diagram of the rotation radius adjusting assembly according to an embodiment of the present disclosure.
Figure 8:
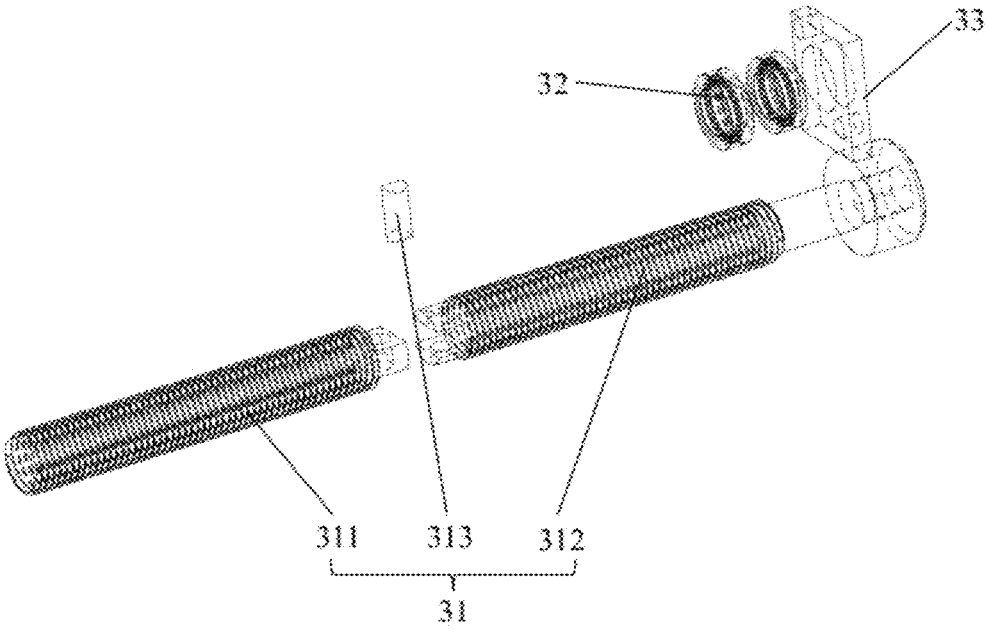
FIG. 8 is an exploded view of a driving assembly according to an embodiment of the present disclosure.
Figure 9:
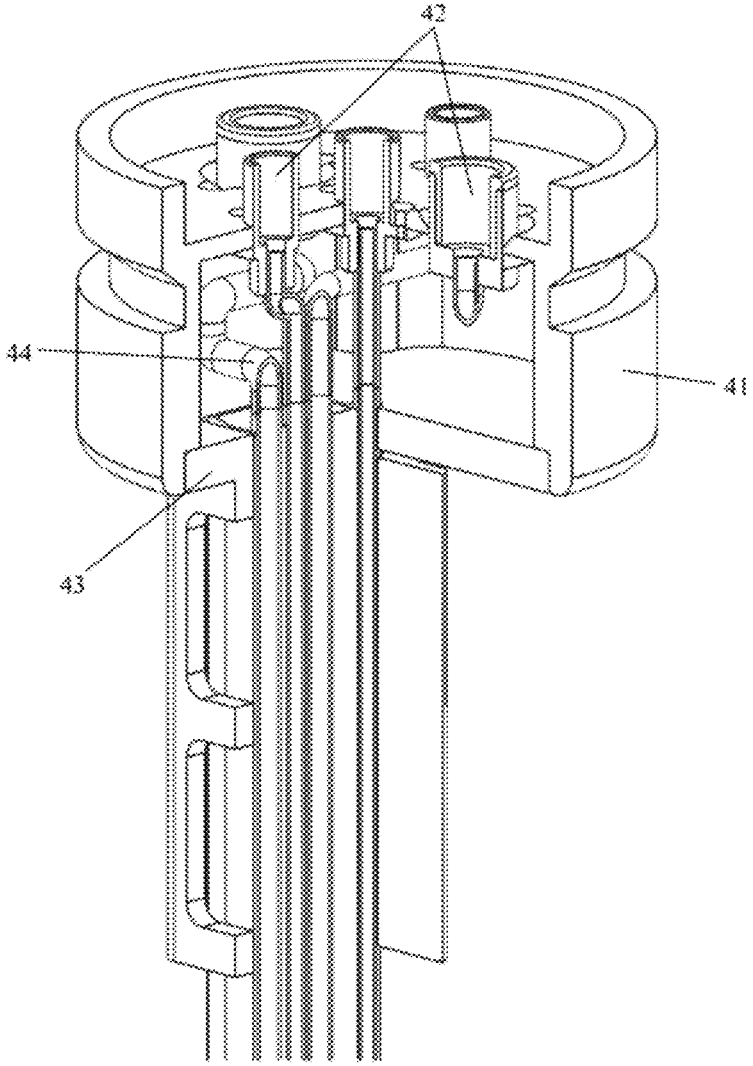
FIG. 9 is a partial cross-sectional view of a spray gun docking assembly according to an embodiment of the present disclosure.

The driving assembly 3 includes a screw assembly 31. The screw assembly 31 is capable of driving the slide block 13 and the slide seat 21 to move synchronously toward or away from each other, realizing a joint adjustment of the slide block 13 and the slide seat 21. The directions indicated by the arrows shown in FIG. 2 are respectively the moving direction of the slide block 13 and the moving direction of the slide seat 21 in a case where the slide block 13 and the slide seat 21 move away from each other.

The screw assembly 31 includes a left-handed screw 311, a right-handed screw 312 and a locating pin 313, the locating pin 313 is configured to connect the left-handed screw 311 and the right-handed screw 312. The left-hand screw 311 is screwed to the slide block 13, and the right-hand screw 312 is screwed to the slide seat 21.

A left-handed thread hole is arranged on the slide block 13, and the left-handed screw 311 is screwed to the left-handed thread hole to adjust the distance between the slide block 13 and the central axis of the fixing plate 11. A positioning part is arranged on the slide seat 21, and a right-handed thread hole is arranged on the positioning part, and the right-handed screw 312 is screwed to the right-handed thread hole to adjust the distance of the central axis of the slide seat 21 and the central axis of the fixing plate 11.

The screw assembly 31 is rotatably connected with the fixed block 12. An end of the screw assembly 31 is provided with a deep groove ball bearing 32 and a bearing cap 33. Both the deep groove ball bearing 32 and the bearing cap 33 sleeve on the right-handed screw 312. The fixed block 12 is provided with a bearing holder, and the deep groove ball bearing 32 is arranged in the bearing holder. The axial movement of the bearing is limited by the bearing cap 33, such that the screw assembly 31 can only rotate around its own axis.

In order to maintain the rotation balance of the spray gun when the spray gun is rotating at different rotation radii, the slide block 13 for counterweight needs to be adjusted to the corresponding position. Therefore, the pitch of the left-handed inner/outer screw and the pitch of the right-handed inner/outer thread are different (the screws are rotated by the same number of turns), and the specific determination method is as follows.

The mass of the fixed block 12, the mass of the gun body (including the rotation radius adjusting assembly 2, the docking assembly 4 and the plasma spray gun) and the mass of the slide block 13 are respectively $m_1$, $m_2$ and $m_3$. The initial distance between the center of mass of the fixed block 12 and the rotation center, the initial distance between the center of mass of the gun body and the rotation center, the initial distance between the center of mass of the slide block 13 and the rotation center are respectively $r_1$, $r_2$, and $r_3$. The condition to realize the linkage between the gun body and the slide block 13 is that the center of mass of the fixed block 12, the center of mass of the gun body and the center of mass of the slide block 13 are coplanar, and specifically, they are on the movement plane of the gun body.

As the slide block 13 and the slide seat 21 are in balance at their initial positions, in the initial-position balance, the following equation is satisfied.

$$m_1r_1+m_2r_2=m_3r_3 \quad (1).$$

The rotation radius of the spray gun is changed by rotating the screw assembly 31 by N turns, and the center of mass of the slide seat 21 is changed by $\Delta r_2$, correspondingly the joint displacement of the slide block 13 is $\Delta r_3$, and a new balance is achieved, in which:

$$m_1r_1+m_2(r_2+\Delta r_2)=m_3(r_3+\Delta r_3) \quad (2)$$

According to (1) and (2), a new equation (3) is obtained:

$$h_3=(m_2/m_3)h_2 \quad (3)$$

$h_3$ is the pitch of the left-handed thread, and $h_3=\Delta r_3/N$, $h_2$ is the pitch of the right-handed thread, and $h_2=\Delta r_2/N$.

In the operation, both the slide block 13 and the slide seat 21 start to move from the central axis of the fixing plate 11. The slide block 13 and the slide seat 21 can be simultaneously moved away from each other by rotating the screw assembly 31. When the slide block 13 and the slide seat 21 are at appropriate positions, the slide block 13 and the fixing plate 11 are fixed by the compression screw 16, and the slide seat 21 and the fixed block 12 are fixed by the compression screw 16.

Figure 10:
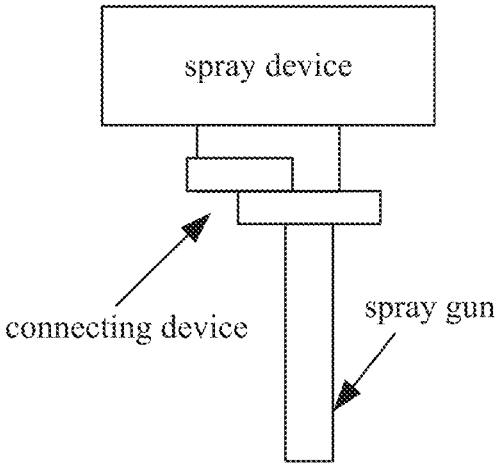
FIG. 10 is a schematic diagram of an internal plasma spraying system.

The present disclosure further provides an internal plasma spraying system. As shown in FIG. 10, the internal plasma spraying system includes a spray device, a spray gun, and the connecting device in the above embodiments. The connecting device is configured to connect the spray device and the spray gun. Specifically, the fixing plate of the balance adjusting assembly of the connecting device is fixed to the spray device, and the spray gun is mounted to the docking assembly of the connecting device.

The above-mentioned embodiments are merely illustrates the basic principles and characteristics of the present invention, and the present invention is not limited to the above-mentioned embodiments. Therefore, while the present disclosure has been described in detail via the above-mentioned embodiments, the present disclosure is not limited to the above-mentioned embodiments and may include more other equivalent embodiments without departing from the concept of the present. The scope of the invention is determined by the scope of the appended claims and their equivalents.

What is claimed is:

1. A connecting device for an internal plasma spraying system, configured to connect a spray gun and a spray device, comprising:

a balance adjusting assembly, comprising a fixing plate and a slide block, wherein the fixing plate is configured to be fixed to the spray device, and the slide block is slidably connected with the fixing plate;

a rotation radius adjusting assembly, comprising a slide seat, wherein the slide seat is slidably connected with the balance adjusting assembly;

a driving assembly, comprising a screw assembly, wherein the screw assembly is configured to drive the slide block and the slide seat to move synchronously toward or away from each other; and a docking assembly, wherein the docking assembly is detachably connected with the rotation radius adjusting assembly, and is configured to be connected with the spray gun;

wherein the slide seat is provided with a cavity, a plurality of first jointers are arranged in the cavity, and the docking assembly is provided with a plurality of second jointers which are in one-to-one correspondence with the plurality of first jointers.

2. The connecting device according to claim 1, wherein the balance adjusting assembly further comprises a fixed block, the fixed block is detachably connected with the fixing plate, the slide seat is slidably connected with the fixed block, and the screw assembly is rotatably connected with the fixed block.

3. The connecting device according to claim 1, wherein the balance adjusting assembly further comprises a limiting block, the slide block is provided with a groove, a first end of the limiting block is fixed to the fixing plate, a second end of the limiting block is in the groove, and the second end of the limiting block abuts an inner sidewall of the groove when a distance between the slide block and the slide seat is maximum.

4. The connecting device according to claim 1, wherein the balance adjusting assembly further comprises a compression screw, and the compression screw is configured to fix the slide block to the fixing plate in response to determining that the slide block is in position.

5. The connecting device according to claim 1, wherein the rotation radius adjusting assembly further comprises two locking rings configured to open or close the cavity, a first end of each of the two locking rings is rotatably connected with the slide seat, and second ends of the two locking rings are detachably connected with each other by a locking lever.

6. The connecting device according to claim 5, wherein one side of the slide seat is provided with a sheath, the sheath comprises two rotary shafts arranged in parallel and spaced apart from each other, and each of the two locking rings is rotatably connected with a respective one of the two rotary shafts.

7. The connecting device according to claim 5, wherein the docking assembly comprises a spray gun holder, the plurality of second jointers are arranged on the spray gun holder, the spray gun holder is detachably connected with the two locking rings, and each of the plurality of second jointers is connected with the spray gun via a copper pipe.

8. The connecting device according to claim 7, wherein an inner wall of each of the two locking rings is provided with a protrusion, and an external surface of the spray gun holder is provided with a recess engagable with the protrusion.

9. The connecting device according to claim 1, wherein the screw assembly comprises a left-handed screw, a right-handed screw and a locating pin, the locating pin is configured to connect the left-handed screw and the right-handed screw, the left-hand screw is screwed to the slide block, and the right-hand screw is screwed to the slide seat.

10. A connecting device for an internal plasma spraying system, comprising:

a fixing plate, having a first dovetail groove;

a slide block, configured to slide along the first dovetail groove;

a fixed block, fixed to the fixing plate and having a second dovetail groove;

a slide seat, configured to slide along the second dovetail groove; and a spray gun holder, fixed to the slide seat, wherein the fixing plate is configured to be fixed to a spray device of the internal plasma spraying system, and a spray gun of the internal plasma spraying system is configured to be fixed to the spray gun holder, wherein the slide block and the slide seat are configured to synchronously move toward or away from each other;

wherein the fixing plate has a circular shape, both of the first dovetail groove and the second dovetail groove extend in a radial direction of the fixing plate;

the connecting device further comprises a limiting block fixed to the fixing plate, wherein the slide block has a groove extending in the radial direction of the fixing plate, the groove of the slide block has a first end, a second end closer to a central axis of the fixing plate than the first end of the groove of the slide block, two lateral sidewalls and an inner sidewall, the inner sidewall is at the second end of the groove of the slide block;

wherein the slide block has a first position and a second position, when the slide block is at the first position, the slide block abuts the fixed block, when the slide block is at the second position, the limiting block abuts the inner sidewall of the groove of the slide block, wherein the slide seat has an initial position where a central axis of the slide seat and the central axis of the fixing plate coincide.

11. A connecting device for an internal plasma spraying system, configured to connect a spray gun and a spray device, comprising:

a balance adjusting assembly, comprising a fixing plate and a slide block, wherein the fixing plate is configured to be fixed to the spray device, and the slide block is slidably connected with the fixing plate;

a rotation radius adjusting assembly, comprising a slide seat, wherein the slide seat is slidably connected with the balance adjusting assembly;

a driving assembly, comprising a screw assembly, wherein the screw assembly is configured to drive the slide block and the slide seat to move synchronously toward or away from each other; and a docking assembly, wherein the docking assembly is detachably connected with the rotation radius adjusting assembly, and is configured to be connected with the spray gun;

wherein the screw assembly comprises a left-handed screw, a right-handed screw and a locating pin, the locating pin is configured to connect the left-handed screw and the right-handed screw, the left-hand screw is screwed to the slide block, and the right-hand screw is screwed to the slide seat.

* * * * *